United States Patent [19]

Schenk

[11] 3,972,630

[45] Aug. 3, 1976

[54] WRITING IMPLEMENT

[75] Inventor: Richard Schenk, White Plains, N.Y.

[73] Assignee: Stacie Pen Corporation, Brooklyn, N.Y.

[22] Filed: Apr. 16, 1975

[21] Appl. No.: 568,402

[52] U.S. Cl. ..... 401/217

[51] Int. Cl.[2] ..... B43K 7/02

[58] Field of Search ..... 401/209–217

[56] References Cited

UNITED STATES PATENTS

| | | | |
|---|---|---|---|
| 2,910,045 | 10/1959 | Gordo et al. | 401/209 |
| 3,282,254 | 11/1966 | Malm et al. | 401/217 |

FOREIGN PATENTS OR APPLICATIONS

| | | | |
|---|---|---|---|
| 1,256,946 | 2/1961 | France | 401/214 |
| 372,593 | 11/1963 | Switzerland | 401/209 |

*Primary Examiner*—Lawrence Charles
*Attorney, Agent, or Firm*—Larson, Taylor and Hinds

[57] ABSTRACT

A non-retractable ball-point pen is disclosed which comprises an elongate ink cartridge, an elongate barrel having a longitudinal bore therethrough for receiving the cartridge and an end cap for tightly sealing one end of the elongate barrel and for engaging and retaining the cartridge in the barrel. The other end of the barrel has a polygonal cross-section with a diameter smaller than the writing tip of the cartridge. Hence, the walls of the barrel defining the polygonal cross-section frictionally grasp the writing tip and the non-engaging surfaces of these walls provide vent passageways in communication between the interior of the bore and the outside atmosphere for venting the cartridge.

7 Claims, 7 Drawing Figures

WRITING IMPLEMENT

BACKGROUND OF THE INVENTION

1. Field of the Invention

This invention relates to writing implements and in particular relates to non-retractable writing implements of the types commonly called ball-point pens and fiber tip pens employing a non-retractable ink cartridge resiliently mounted inside a housing having improved venting passages for permitting free communication of air and pressure equalization with the interior of the housing.

2. Description of the Prior Art

In all conventional writing implements of the types commonly referred to as ball-point pens and fiber tip pens, the pens comprise ink supply reservoirs or cartridges containing writing fluid. Ball-point pens use a viscous writing fluid and have a rotatable ball tip at the lower end of the cartridge and an open upper end. Fiber tip pens have a tip made from a fiber, such as felt or nylon, and a sponge-type reservoir for absorbing and retaining a readily flowable writing fluid. The cartridge is usually housed in a barrel or housing and if the cartridge is retractable into the barrel, the pen further comprises parts to selectively retract and advance the cartridge.

Nevertheless, in all ball-point pen or fiber tip writing implements, there is a need to provide a supply of air to replace the volume of ink used in writing operations and to equalize the pressure on the ink supply with the outside environment so that the ink can readily flow. On the other hand it is desirable to regulate or limit the flow and the quantity of air admitted to the ink in the cartridge in order to avoid excess accumulation of humid air therein and in order to preclude excessive evaporation of solvent, oxidation of the ink and other undesirable effects produced by excessive access of air to the ink.

In many writing instruments, an air vent to the atmosphere is provided by an aperture in the upper end, or in the barrel or at some location between the point and the upper end. In retractable pens, the point is usually in such a loose fit with the tip of the barrel and at the upper end where the retracting mechanism protrudes from the barrel that ample air can flow.

However, in non-retractable pens in which the relative positions of the cartridge and the barrel are rigidly fixed, a tight fit is usually required betwee the tip of the barrel and the pen point to ensure sufficient lateral point rigidity and prevent early barrel tip failure. In one particular and popular form of non-retractable ball-point writing implements, the pen comprises a plastic barrel with an ink cartridge and point assembly inserted therein. A "button" or cap is provided at its upper end to finish the pen structure. In this type of writing implement, venting is obtained through an orifice in the cap or in the barrel or by permitting loose fit of the point assembly in the barrel tip. In some of these type pens, venting is accomplished at the tip of the barrel by using a crimped metal filler tube which provides the necessary venting channels. Unfortunately, from both a cost and a production standpoint, non-metallic cartridges or easily obtainable non-crimped metal cartridges are more desirable.

Another type of non-retractable ball-point pen which vents at the tip of the barrel is disclosed in the patent to Roy M. Jenkins, U.S. Pat. No. 3,335,706. The pen disclosed in this patent has a plastic ink filled cartridge with integrally formed longitudinal venting grooves therein. However, as disclosed in the Jenkins patent, the size and depth of the grooves is critical and the proper production of the grooves requires expensive manufacturing techniques and equipment. Other venting techniques are disclosed in patents for "piggy-back" cartridges such as Gordo et al, U.S. Pat. No. 2,910,045; Seyer, U.S. Pat. No. 2,971,494 and Malm et al, U.S. Pat. No. 3,282,254. Obviously, the piggy-back cartridges only solve the problem of venting the lower cartridge past the point of the upper cartridge and do not teach a solution to the problem of economically providing accurate venting of the pen barrel to the outside atmosphere.

It is finally noted that it might appear to be relatively simple to provide venting of the pen through an orifice in the barrel. However, this procedure requires an additional manufacturing step beyond that of molding the barrel. Furthermore, it may be aesthetically more pleasing to have a barrel that has no openings along the length thereof.

SUMMARY OF THE INVENTION

The present invention overcomes these and other disadvantages inherent in the prior art and provides a non-retractable writing implement that can be very inexpensively manufactured by injection molding techniques using noncomplicated and inexpensive molds. In addition, the pen can be manufactured from inexpensive and low quality plastic materials in any desired shape or dimension because the venting passages in the pen do not weaken the structure of the pen.

In accordance with one embodiment, the invention comprises a non-retractable writing implement comprising an elongate cartridge, an elongate barrel having a longitudinal bore completely therethrough receiving the cartridge, and an end plug for tightly sealing one end of the elongate barrel. The cartridge contains a liquid ink supply and has a point assembly at one end of the cartridge, the point assembly including a substantially cylindrical writing tip. The end of the bore in the barrel which is opposite the barrel and receiving the plug has a polygonal cross-section for receiving the writing tip of the cartridge. The minimum cross-sectional diameter of the polygonal cross-section is smaller than the cross sectional diameter of the substantially circular writing tip. The walls of the barrel defining the polygonal cross-section have a sufficient flexibility for receiving the writing tip and the inwardly facing surfaces of these walls engage with and frictionally grasp the writing tip. The non-engaging portions of the inwardly facing surfaces provide air passageways in communication with the interior of the bore for venting the cartridge.

Other features and advantages of the present invention will be set forth in or apparent from the detailed description of the preferred embodiments of the invention found hereinbelow.

DESCRIPTION OF THE PREFERRED EMBODIMENTS

Referring to the figures in which like numerals depict like elements, there is depicted a non-retractable ballpoint pen 10 in accordance with the invention. Pen 10 comprises an elongate barrel 12 and a cap 14 in engagement with barrel 12 covering the writing end of pen 10. Barrel 12 has an outer diameter such that cap 14 can be placed on either end thereof (compare FIG. 1 with FIG. 2). Cap 14 has a spring clip 16 so that pen 10 can be securely retained in a pocket of a user of the pen.

Figure 1:
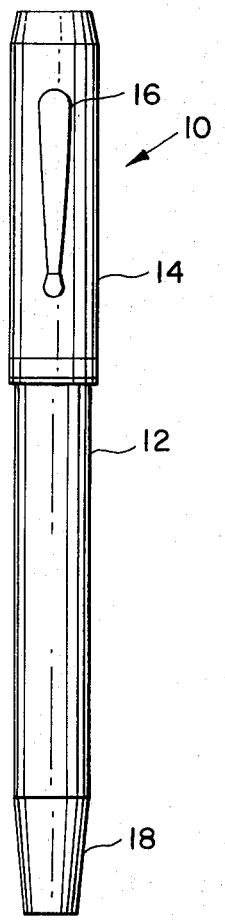
FIG. 1 is a top plan view of one embodiment of a non-retractable ball-point pen in accordance with the invention.
Figure 3:
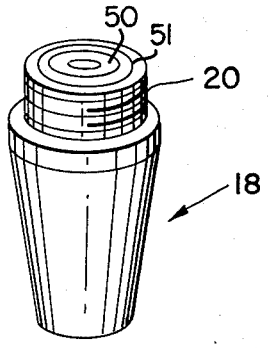
FIG. 3 is a perspective view of the end plug.

Referring to FIGS. 1 and 3, the end of barrel 12 opposite the writing end comprises a removable solid plastic end plug 18. End plug 18 is provided with external threads 20 at one end thereof for permitting easy removal from barrel 12 or, on the other hand, for providing a tight seal with barrel 12 when inserted therein.

Figure 2:
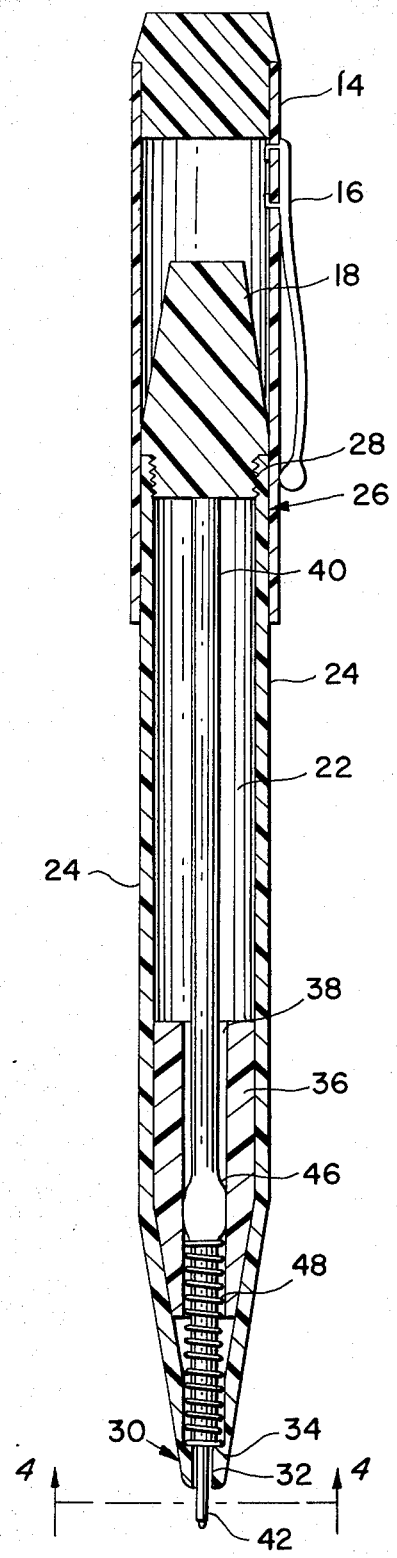
FIG. 2 is a longitudinal cross-sectional view of the pen shown in FIG. 1, but depicting the cap positioned on the end of the pen opposite the writing end.

As can best be seen in FIG. 2, barrel 12 is provided with a longitudinal bore 22 completely therethrough and defined by walls 24. Barrel 12 has a non-writing, or top end 26 with internal threads machined on the inside thereof for mating with threads 20 of end plug 18. Walls 24 at the other end or the barrel tip 30 of barrel 12 converge inwardly to form an outside shape that is a truncated cone in cross-section and which has a narrowing smaller bore 32 coaxial with bore 22 and in communication therewith and with the external environment. Barrel 12 is comprised of a relatively rigid material, such as a plastic or synthetic resin, which is also slightly resilient so that walls 24 at barrel tip 30 can be forced slightly outwardly by an object extending through smaller bore 32. At the point where smaller bore 32 joins bore 22, walls 24 form inwardly projecting flanges 34.

Figure 5:
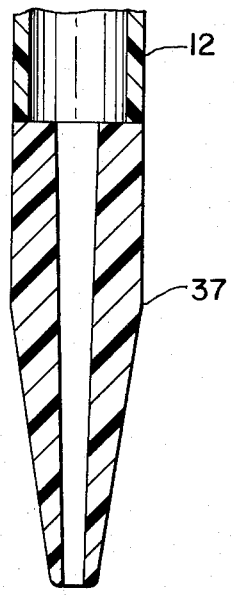
FIG. 5 is a longitudinal cross-sectional view of an alternate embodiment of the barrel of the pen shown in FIG. 2.
Figure 6:
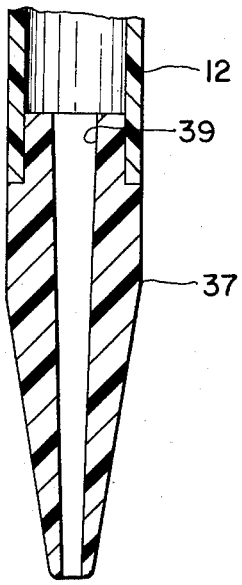
FIG. 6 is a longitudinal cross-sectional view of a further alternate embodiment of the barrel of the pen shown in FIG. 2.

Additional rigidity and support is provided in the general area of barrel tip 30 and for a longitudinal distance therefrom by a generally cylindrical insert 36 that has an outer shape that conforms to the inner shape of walls 24. Insert 36 has a bore 38 therethrough which is in coaxial alignment and in communication with both bore 22 and smaller bore 32. Alternatively, in another embodiment as shown in FIG. 5, barrel 12 can terminate at a point where the cross-section thereof is still cylindrical and a separate barrel tip 37 having a wall thickness equal to the combined thickness of walls 24 and insert 36 can be rigidly attached in coaxial alignment with barrel 12. A third alternative as shown in FIG. 6 can include an embodiment similar to the aforedescribed alternative embodiment, but wherein the barrel tip 37 has an end part 39 which is received by and extends into the end of barrel 12.

An elongate ink cartridge 40 for containing a viscous ink supply and having a point assembly with a substantially cylindrical writing tip 42 located at the lower end thereof is disposed within bores 22, 32, and 38 of barrel 12. Ink cartridges of the type used as part of the present invention are well known and can be made of either metal or a plastic material. In most cases, however, writing tip 42 is made of a metal material and has a rotatable ball at the lower end thereof for applying a controlled amount of the liquid ink supply. The typical diameters of writing tips are on the order of sixty-five to ninety-thousandth of an inch.

Figure 4:
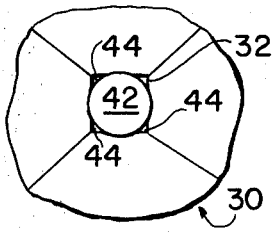
FIG. 4 is an end elevational view of the writing end of the pen shown in FIG. 2 and taken along line 4—4 thereof.

In accordance with the present invention, smaller bore 32 has a polygonal cross-section and, as shown in FIG. 4, has a preferred cross-sectional shape of a square. The cross-sectional diameter of smaller bore 32 in the presently preferred embodiment of the invention is on the order of sixty-five thousandth of an inch, and hence approximately equal to or up to twenty-five thousandth of an inch smaller than the typical diameters of writing tip 42. Therefore, the portions of the walls 24 defining the polygonal cross-section of the bore are required to have a sufficient flexibility for permitting a larger writing tip to be inserted therethrough. It is noted that if smaller bore 32 had a circular cross section, when a larger diameter writing tip is inserted through the circular bore, the barrel tip could crack. In addition, the inwardly facing surfaces of walls 24 engage and frictionally grasp writing tip 42 and securely retain cartridge 40 in place. Those portions of walls 24 not in engagement with cartridge 40 provide vent passages 44 through which the interior portions of bore 22 are in communication with the atmosphere exterior thereto.

As shown in FIG. 2, cartridge 40 has a flared section 46 along the length thereof for receiving a helical compression spring 48. Flared section 46 is located closer to writing tip 42 and is spaced therefrom a sufficient distance so that when cartridge 40 is installed with barrel 12, spring 48 is under compression between flared sections 46 and flanges 34.

End plug 18 has a substantially flat or planar end or surface 50 located at the end thereof proximate to threads 20. However, surface 50 has sufficient non-planar characteristics so that the open end of cartridge 40 which is in engagement therewith is not completely sealed so as to provide for a controlled venting of the ink inside cartridge 40. The non-planar characteristics can be accomplished with concentric ridges 51, or instead could include a knurled surface or cross hatched ridges. Alternatively, surface 50 can be planar and the non writing end of cartridge 40 can be indented to provide an air passageway.

Thus cartridge 40 is resiliently mounted in bore 22 of barrel 12 between end surface 50 of end plug 18 and flanges 34 of barrel tip 30. Resilient mounting of cartridge 40 ensures that the cartridge is maintained snugly within barrel 12.

In operation, it can be seen that the ink supply within cartridge 40 is continuously vented to the outside atmosphere. The air venting the ink supply follows a tortuous path that consists of the inside of cartridge 40 to the top thereof and along surface 50 of end plug 18, through bore 22, through bore 38, and through the vent passages 44 in smaller bore 32 to the outside atmosphere. One advantage from the air being required to follow a tortuous path is that it helps to ensure that any water vapor contained in the air does not reach the ink supply contained in cartridge 40. Another advantage is that the amount of air entering the top of cartridge 40 is restricted so that the evaporation of the ink supply is greatly reduced. However, sufficient air is permitted to enter the top of cartridge 40 to replace the ink supply as it is used and to permit atmospheric pressure fluctuations to be transmitted to the ink supply which helps to ensure a more continuous flow of ink.

When the ink supply in cartridge 40 is depleted, cartridge 40 can be easily removed and replaced by unscrewing end plug 18 and withdrawing cartridge 40 from barrel 12.

Figure 7:
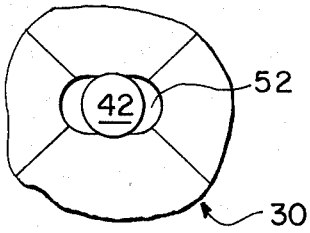
FIG. 7 is an end elevational view similar to FIG. 4 showing an alternate embodiment of the barrel end opening.

The cross-sectional shape of smaller bore 32 has been described as polygonal. However, it is realized that this term includes those cross-sections in which the straight lines of the figure are connected by curved lines, such as in a race-track-type ellipse shown at 52 in FIG. 7. The important feature of the cross-sectional shape of smaller bore 32 is that air passages are provided between writing tip 42 and concentric walls 24 and that the engaging portions of the walls 21 tightly grip writing tip 42.

The present invention has been described with regards to a ball-point pen. However, it is noted that the invention also encompasses a non-retractable fiber tip pen or any non-retractable writing implement that requires the venting of the writing fluid.

Although the invention has been described in detail with respect to exemplary embodiment thereof, it will be understood by those of ordinary skill in the art that variations and modifications may be effected within the scope and spirit of the invention.

I claim:

1. A non-retractable writing implement comprising:

an elongate cartridge for containing a liquid ink supply and having a point assembly at one end thereof with a substantially cylindrical writing tip;

an elongate cylindrical barrel having a longitudinal bore completely therethrough receiving said cartridge, said bore having at one end thereof a polygonal cross-section for receiving said writing tip, the minimum cross-sectional diameter of said bore at said one end being no more than substantially equal to the substantially circular cross-sectional diameter of said writing tip, the walls of said barrel defining said polygonal cross-section being substantially smooth and having a sufficient flexibility for receiving said writing tip and the inwardly facing surfaces of said walls for engagement with and preventing lateral movement of said writing tip, the non-engagement portions of said surfaces providing air passageways in communication with the interior of said bore for venting said cartridge;

and an end plug for tightly sealing the other end of said elongate barrel so as to prevent air flow therebetween wherein said end plug has a substantially flat end for non-sealingly engaging the end of said cartridge opposite said writing tip and for permitting a controlled venting of the ink inside said cartridge.

2. A writing implement as claimed in claim 1 wherein said polygonal cross-section is square.

3. A writing implement as claimed in claim 1 and further comprising a spring for resiliently mounting said cartridge in said barrel.

4. A writing implement as claimed in claim 1 wherein said end plug is in coaxial alignment with said cartridge and frictionally engages the end thereof opposite said writing tip.

5. A writing implement as claimed in claim 3 wherein said end plug is solid plastic having threads at one end thereof, and said other end of said elongate barrel having threads in the bore thereof for removably receiving said end plug; said writing implement thereby permitting replacement of said cartridge when the ink therein has been depleted.

6. A writing implement as claimed in claim 1 wherein said end plug is solid plastic having threads at one end thereof, and said other end of said elongate barrel having threads in the bore thereof for removably receiving said end plug; said writing implement thereby permitting replacement of said cartridge when the ink therein has been depleted and further comprising a spring for resiliently mounting said cartridge in said barrel.

7. A writing implement as claim in claim 1 wherein said minimum cross-sectional diameter of said bore at said one end is smaller than the substantially circular cross-sectional diameter of said writing tip, the walls of said barrel at said one end frictionally grasping said writing tip.

* * * * *